US005743468A

United States Patent [19]

Laidler

[11] Patent Number: 5,743,468

[45] Date of Patent: Apr. 28, 1998

[54] SPRAYING APPARATUS AND NOZZLE DEVICES

[75] Inventor: Kevin O. Laidler, West Midlands, United Kingdom

[73] Assignee: Incro Limited, United Kingdom

[21] Appl. No.: 725,180

[22] Filed: Oct. 3, 1996

Related U.S. Application Data

[63] Continuation-in-part of PCT/GB96/00441 Feb. 28, 1996.

[30] Foreign Application Priority Data

Apr. 6, 1995 [GB] United Kingdom ..... 9507185
Feb. 28, 1996 [GB] United Kingdom ..... 9605118

[51] Int. Cl.[6] ..... B05B 15/02; B05B 1/00

[52] U.S. Cl. ..... 239/115; 239/123; 239/337; 239/333; 239/526; 239/600

[58] Field of Search ..... 239/114, 115, 239/526, 337, 333, 123, 600; 222/148, 342, 383.1, 402.1, 402.12

[56] References Cited

U.S. PATENT DOCUMENTS

| | | | |
|---|---|---|---|
| 3,178,120 | 4/1965 | Kappel et al. . | |
| 3,961,756 | 6/1976 | Martini . | |
| 4,013,231 | 3/1977 | Van Veldhoven . | |
| 4,253,609 | 3/1981 | Laauwe | 239/600 X |
| 4,901,891 | 2/1990 | Gonclaves . | |
| 4,917,303 | 4/1990 | Maas et al. | 239/333 |
| 5,105,988 | 4/1992 | Knickerbocker | 239/115 X |
| 5,316,470 | 5/1994 | Sigler | 239/600 X |
| 5,373,991 | 12/1994 | Nelson | 239/333 |

FOREIGN PATENT DOCUMENTS

| | | |
|---|---|---|
| 9402633 0 U | 6/1976 | Germany . |
| 804 805 | 11/1958 | United Kingdom . |
| 1 326 714 | 8/1973 | United Kingdom . |
| 2 161 401 | 1/1986 | United Kingdom . |
| WO88/00165 | 1/1988 | WIPO . |
| WO95/01227 | 1/1995 | WIPO . |
| WO95/07850 | 3/1995 | WIPO . |

*Primary Examiner*—Kevin Weldon
*Attorney, Agent, or Firm*—Neil F. Markva

[57] ABSTRACT

A hollow body having a nozzle opening to discharge fluid as a jet or spray; the body comprising a first part having an inlet to admit fluid under pressure into the first part, and a second part movable relative to the first part and said first and second parts are relatively movable from an abutting position in which they define therebetween the nozzle opening and a fluid feed passage in the body and leading to the nozzle opening, and a cleaning position in which the fluid feed passage is split open longitudinally and the nozzle opening is split open to expose the nozzle and passage defining and abutting surfaces of said parts, for cleaning.

13 Claims, 6 Drawing Sheets

SPRAYING APPARATUS AND NOZZLE DEVICES

This is a continuation-in-part application of the International Patent Application PCT/GB96/00441, filed Feb. 28, 1996 designating the United States of America, which is based upon GB 9507185.8, filed Apr. 6, 1995 and GB 9605118.0, filed Feb. 28, 1996.

This invention concerns improvements in or relating to nozzle devices used in spraying apparatus, of a kind comprising a hollow body having a nozzle opening to discharge fluid as a jet or spray; the body comprising a first part having an inlet to admit fluid under pressure into the first part, and a second part movable relative to the first part; wherein the nozzle opening and a feed passage leading to the nozzle opening meet at a junction and are defined between portions of abutment surfaces of the first and second parts; and wherein the parts are at least partially separable to expose the feed passage and the nozzle opening and the junction for wiping.

DE.U.9402633 discloses a nozzle device of said kind, in the form of a machined assembly which uses two threaded fasteners to clamp a planar abutment surface of a cover plate part onto an abutment surface of a nozzle body part so as to cover one side of a hollow formation providing a nozzle, a feed passage and an inlet duct recess, in the hollow body. For cleaning of the abutment surfaces, the assembly has to be disassembled, i.e. both fasteners need to be removed and the cover plate part lifted off the body in order to move its planar abutment surface directly away from the abutment surface on the body part. One of the fasteners extends through a cut-out in the cover part so that when the fasteners are partially released the cover part can be pivotally moved about the axis of the other fastener. However, even when the nozzle opening is exposed by such pivotal movement, portions of the abutment surfaces remain in abutment and cannot be wiped clean and it is self-evident that any accumulation or deposit of material on said surfaces could prevent an effective sealing engagement thereof notwithstanding the high clamping pressures which can be achieved by tightening of threaded fasteners.

This nozzle device of DE.U.9402633 is designed for use in a spray booth as part of a spraying installation and is not intended for, or suitable for, or capable of being adapted for inexpensive production, e.g. as a simple injection moulding of plastics material, as is necessary for inexpensive nozzle devices for use with an aerosol spray can, unlike WO A 95 07 580 which discloses a two-part plastics injection moulding and is primarily directed to the provision of a very smooth curved path or feed passage between an inlet and a nozzle outlet so as to reduce the tendency of materials to accumulate along the feed path in a moulded plastic nozzle device for an aerosol spray can. In most embodiments a two part body is used to hold in place a flexible tube which integrally includes the inlet, feed passage and nozzle opening, whereas in the embodiment shown in FIG. 14 the tube is omitted and the feed passage is defined between the two parts of the body, and these two parts are permanently connected together by an integral hinge, and together provide sockets for an inlet member and a separate nozzle member which respectively define the inlet and the nozzle opening. However, in no embodiment can the nozzle opening be wiped clean if it blocks so that the problem of nozzle blockage and effective sealing of the interface between said parts in the FIG. 14 embodiment remain.

WO 95 01 227 discloses a machined assembly in which a stepped piston has a shaped end in which half of each of a feed passage and nozzle opening are defined, which piston can be shifted by appropriate application of fluid pressure to widen or narrow the feed passage and nozzle opening. However, at no time are the abutting surfaces (in which the feed passage and nozzle opening are defined) openly exposed for wiping nor can they be separated by relative pivotal movement, instead the piston is shifted to widen the nozzle opening so that blocking particles can be transported away by the flow of fluid.

GB A 804805 discloses a nozzle in which two parts together define a feed passage and a nozzle opening, but these two parts are not hinged together so as to be capable of being swung directly apart to allow the abutment surfaces to be cleaned: instead a mechanical internal wiper mechanism is employed to clean only the passage and nozzle opening. This complex and relatively costly piece of equipment is designed for spraying articles as they pass along a conveyor in an industrial spraying process, and is not suitable for cheap-mass production use with an ordinary aerosol can.

U.S. Pat. No. 3,178,120 discloses an aerosol can nozzle of two part construction in which one of the parts is wholly detachable from the other part and has a part cylindrically C-shaped projection which can only be driven linearly into a deep complementary socket in the other part to hold the parts together and provide a barrier to egress of fluid from the inlet through the interface between the two parts. However, the feed passage and the adjacent parts of the interface extends through the gap in the aforementioned C-shape so that fluid can egress therethrough unless the parts sealingly engage at said interface. Further, as anybody who has attempted to clean out a paint spray can nozzle knows, paint has a nasty tendency to get everywhere. If a spray fluid spills from the inlet of U.S. Pat. No. 3,178,120 into the C-shaped socket when the C-shaped projection has been pulled out, such paint contamination could prevent the projection being fully re-inserted and prevent the nozzle opening and feed passage being accurately reformed to the original geometry to the possible detriment of the quality of the spray pattern. The narrowness and depth of the C-shaped socket would hinder removal of such spillage contamination.

Aerosol spray cans, trigger pumped hand held spray bottles and like manually actuable portable spray apparatus is commonly used in circumstances, e.g. gardens, worksites, etc, where dismantling of or removal of the spray nozzle is inconvenient and in which the spray nozzle (or parts thereof) is or are not easily found if dropped. Dismantling of the nozzle device for cleaning gives rise to problems and should therefore be avoided.

Such apparatus commonly suffers from blockages caused by neglect, i.e. not being cleaned after use so that a spray fluid residue dries out or sets in the interior of the nozzle.

Where fine nozzle openings are concerned for producing "atomized" sprays, the use of even a very fine implement to unblock the nozzle opening may not be practical or expedient, and may lead to damage to the nozzle to the detriment of the spray pattern.

U.S. Pat. No. 3,961,756A discloses a nozzle device in which the first part is formed to provide both the inlet and the nozzle opening, and the second part is in the form of a threaded valve plug which is rotatable in a threaded socket in the first part to move axially relative to the internal side of the nozzle opening to vary the spray pattern. The plug is removable to provide access via the threaded socket to the inside face of the nozzle opening for insertion of an implement for removal of matter blocking the inside side of the opening.

In order to overcome said problems and permit simple and effective cleaning, the present invention provides a nozzle device of said kind which is characterised in that the first part is attached to the second part by an integral flexible hinge which allows one of said parts to be swung away from the other to separate and expose said surfaces entirely whilst the parts remain connected by the hinge, and in that said parts have sealing means bordering said portions of said surfaces adjacent to said nozzle opening junction and feed passage; and in that said sealing means comprises a projecting formation on one of said surfaces which sealingly engages in a recessed formation, which is disposed in the other surface and extends to the periphery of said surface, when said parts are swung together to abut at an interface between said surfaces and are held in abutment by flexible retaining means which is of snap-fit form.

In a preferred embodiment the first part is a base attachable to a fluid container vessel having valve means openable by movement of the base to supply a flow of the fluid under pressure to the inlet, and the second part is a lid which can be pushed or prised off the base and swung open for cleaning, and can be swung into snap-fit engagement with the base so that the sealing means automatically becomes effective as the lid closes on the base.

The surfaces are preferably stepped to provide inclined surface portions which serve as guide means and the, or part of, said sealing means. Each of said surfaces preferably has a concavity therein which defines part of each of the nozzle opening, the feed passage and the junction. The junction is preferably formed as a swirl chamber or the junction or feed passage is provided with swirl means to impart rotary motion to the fluid as it passes from the inlet to the nozzle opening.

The invention includes spraying apparatus comprising the nozzle device, a vessel containing fluid under pressure, valve means actuable by depression of a pipe in the valve means to release said fluid into said pipe, wherein the device and pipe are arranged so that manual application of pressure to a top surface of a flexible web or the lid is transmitted via the interface and sealing means to the base to move the body towards said vessel for actuating said valve means.

A cleaning member is preferably provided for the nozzle device in order to obscure said nozzle opening and to wipe said nozzle opening when the body is depressed to open the valve means.

The invention also includes spraying apparatus comprising the nozzle device attached to an outlet of a body of the apparatus, a vessel to contain fluid to be sprayed releasably attached to said body, and a trigger actuable for pumping fluid from said vessel to the nozzle device via said outlet.

A cleaning member is preferably provided on the trigger to obscure and wipe said nozzle opening.

The sealing means is preferably disposed to interrupt or act between said surfaces adjacent to the nozzle opening and feed passage to limit egress of pressurised fluid between said abutting surfaces and to confine said pressurised fluid to flowing along said passage to the nozzle opening.

Said body is preferably formed from a resilient plastics material so that retaining formations on said parts interengage resiliently to serve as retaining means to bias said portions of said surfaces together.

The retaining formations preferably further include a pair of pegs projecting from one of said parts which are a push fit into openings in webs of the other of said parts. The webs preferably extend between the interengaging means and the periphery of the said other part and are sufficiently resilient to grip said posts.

The retaining formations preferably include a dependent peripheral flange means on the lid to embrace a peripheral surface of the base, which flange means is interrupted by the hinge and the nozzle opening.

Preferably, the body further comprises interengagement or guide means comprising a male formation on one of said parts engagable in a female formation in the other of said parts, each formation providing respective said inclined surface portions (i.e. inclined to said surface portions bordering the nozzle opening and feed passage); and wherein said female formation serves to guide and determine the exact position of the male formation when the portions of said surfaces are brought into abutment to ensure accurate registration of said portions of the abutment surfaces.

The female formation preferably extends to the periphery of the body, so that when said parts are separated, matter can be swept or driven out of the female formation via the peripherally open end of said formation.

Said open end is preferably normally covered by said flange means.

The nozzle device preferably further comprises a cleaning member which is disposed to abut an internal surface of the body around the nozzle opening, which cleaning member is movable relative to said external surface, upon actuation of a manually actuable part, between a position wherein the nozzle opening is obstructed by the cleaning member and a position in which the nozzle opening is exposed, so that the cleaning member can wipe or scrape the external surface around the nozzle opening during movement between said positions.

Such problems are particularly prevalent in hand operated spraying apparatus employing small bore nozzles such as are found in aerosol cans, trigger operated spray containers and paint guns; and the invention takes advantage of a mechanical action to effect clearing of the opening or orifice by deformation and reformation, and/or by scraping or wiping of the surface around the opening or orifice each time the manually actuable part is moved by the operator. For example, in an aerosol can or similar apparatus, the manually actuable part may be the surface of the body which is usually depressed (against a bias provided by the fluid pressure, to occasion a flow of the pressurised fluid) so that the first part is pressed towards the second part, or so that the body and nozzle opening are moved relative to the cleaning member; or, instead, the manually actuable part or surface may be provided on or connected to the second part or the cleaning member to shift it and transfer movement to means to release a flow of fluid.

In a trigger pumped hand spray or similar apparatus, the trigger may serve as the manually actuable part and be arranged so that an initial movement thereof is transmitted to the cleaning member leaving the remaining movement (of the full trigger stroke) to be employed for pumping.

The chamber and/or the passage may incorporate or contain flow directing elements of said swirl means which elements may be attached to or formed on or in said body parts so as to be exposed for cleaning when said parts are separated.

The interface between the body parts is preferably transverse to the direction of movement.

The cleaning member or a separate cleaning member preferably moves in the plane in which the opening or orifice opens and comprises a scraper or wiper, a cover part or seal to seal or cover the opening or orifice and obscure the exterior surfaces of the nozzle around said nozzle opening or orifice, and an outlet opening which registers with said nozzle opening or orifice for spray to pass through said member.

The invention includes spraying apparatus incorporating, fitted with or constructed and arranged to be fitted with and operate in conjunction with said nozzle device.

The invention further provides spraying apparatus having a nozzle device comprising a unitary-moulded plastic body comprising a lid and a base, each comprising a respective main web having an abutment surface to abut the abutment surface of the other main web and define therewith a nozzle opening open at the periphery of the body, a feed passage connecting said nozzle opening with a junction so that separation of said lid and base exposes said surfaces and the surface portions bounding said nozzle opening, feed passage and junction and a junction end of an inlet formed in the base, for wiping, wherein said surfaces and webs are shaped to provide sealing means and interengaging guide means both comprising complimentary shaped male and female formations which extend from said periphery to border said portions of said surfaces for determining the positions of said surface portions and effecting sealing around said surface portions when the lid is held in snap-fit abutment with the base by resilient retaining means.

Preferably, the retaining means and interengaging guide means both comprise posts projecting from one of said parts through gripping apertures in the other of said parts.

Preferably, the retaining means comprises flange means on one of said parts to embrace a peripheral surface of the other of said parts.

The invention will be described further, by way of example, with reference to the accompanying diagrammatic drawings, wherein.

Figure 10:
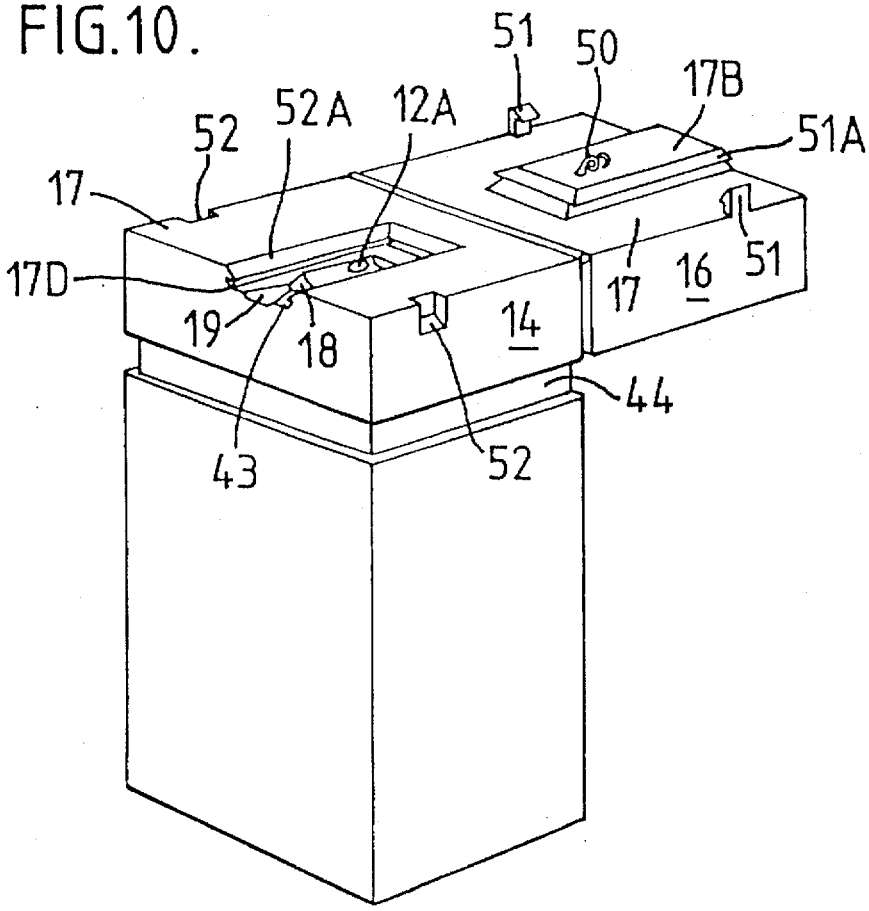
FIG. 10 shows a modified form of the second embodiment in the same condition.
Figure 10A:
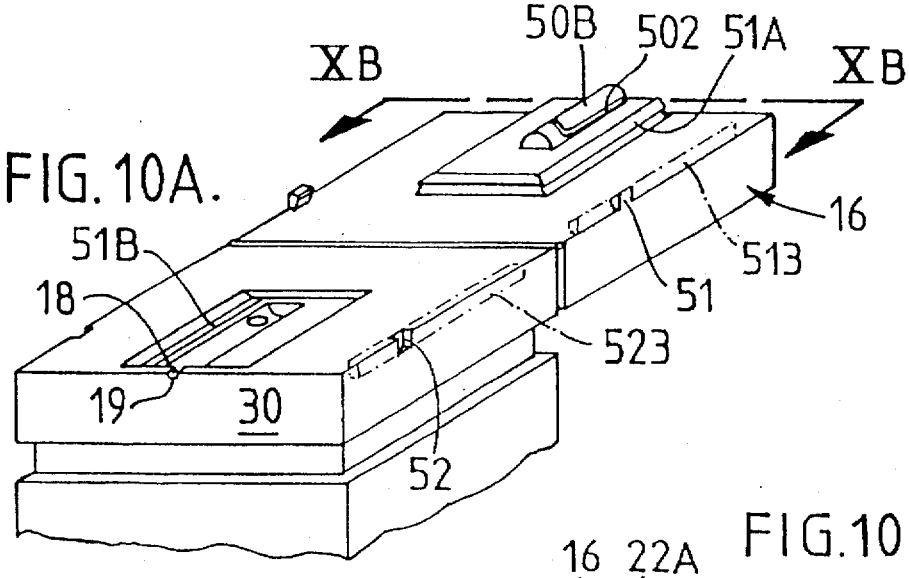
Figure 11:
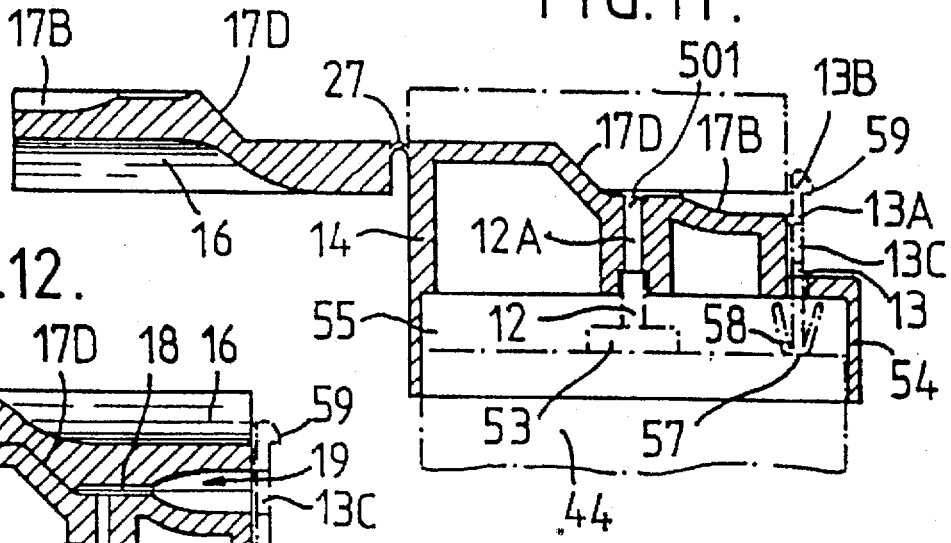
Figure 12:
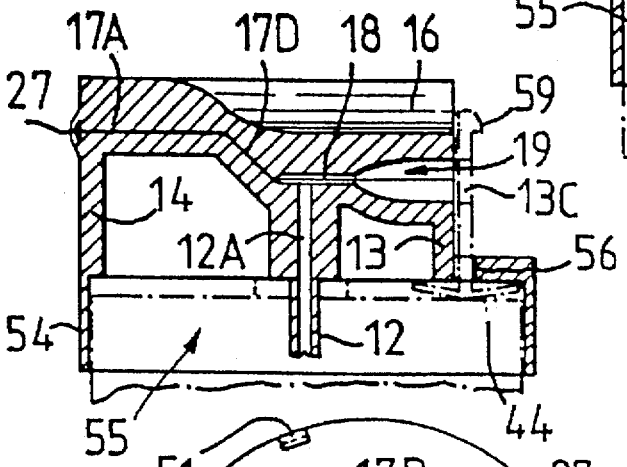
Figure 13:
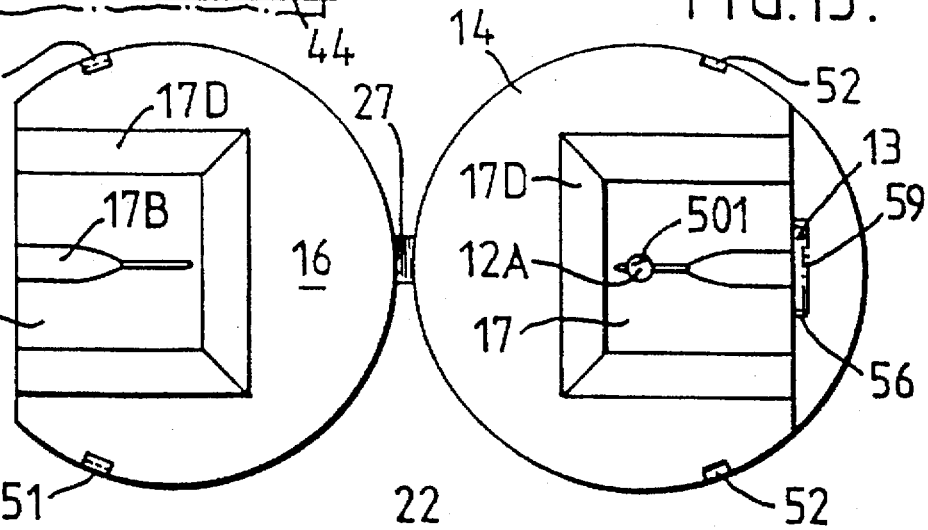

FIGS. 10A and B show modifications of the device shown in FIG. 10;

FIGS. 11 and 12 are sectional views of a third embodiment in an opened for cleaning condition and a closed for spraying condition respectively;

FIG. 13 is a plan view of the third embodiment in the open condition, and

Figure 14:
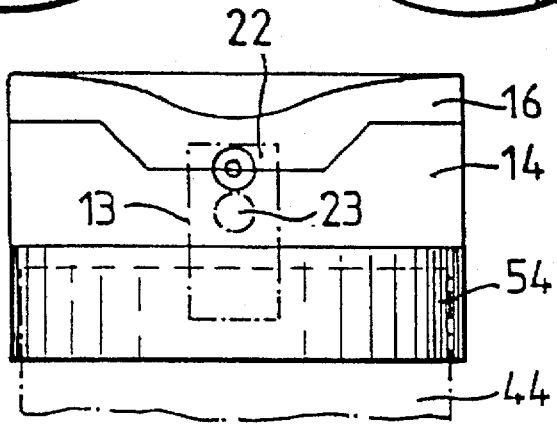

FIG. 14 is a front elevation of the third embodiment in the closed condition.

The first form of the nozzle device 10, as shown in FIGS. 1 to 6 of the drawings, comprises a moulded plastic unitary body 11 which is formed to provide a first part 14 and a second part 16 connected together by an integral flexible hinge 27. The body is preferably of a thermoplastic material which is stiffly and resiliently flexible, e.g. polypropylene.

The first part 14 defines an inlet 12A which leads to a junction or chamber 15 defined between portions 17B of confronting surfaces 17 of the first and second parts. The chamber 15 leads, transversely of the inlet 12A, to a feed passage 18 connecting with the nozzle opening 19, also defined between said portions 17B of the surfaces 17, which opens at the peripheral surface 30 of the body. Said surfaces comprise abutting portions 17C which meet at an interface 17A immediately bordering those portions 17B which define the junction and nozzle opening. The interface 17A is interrupted by sealing means 40 which is adjacent to the junction and nozzle opening and extends around them to the front of said peripheral surface 30, hereby to prevent leakage across said interface 17A from the nozzle opening 19 and junction 15. Said abutting portions 17C extend to guide or interengagement means 18A and B comprising sloping surfaces 17D of a male formation 18A on said part 16 and on a complementary female portion 18B in the said part 14, which surfaces 17D interengage to determine the relative positions of the formations and consequently also the positions of the portions 17B of the surfaces 17 thus accurately defining the geometry of the junction, feed passage and nozzle opening.

The sloping surfaces 17D serve as a further part of the sealing means, and are preferably held together to effect a further seal around the periphery of said portions 17C except where said portions 17C meet the peripheral surface 30 of the body or dependent peripheral flange means 31 on a main web 22B of the part 16. The flange means 31 embraces portions 30A,B of the peripheral surface 30 to serve as retaining means to hold the parts together so that the part 16 serves as a lid on the part 14.

The sealing means 40 also comprises a recess 42 or groove in the base 14 which is U-shaped in plan, and a sealing rib 41 of identical plan shape on the lid 16, the cross-sections of the rib and recess being complementary so that the rib is a snap or squeeze fit in the recess to sealingly engage therein. The ends 43 of the U-shaped recess 42 open at the peripheral surface 30 to each side of the nozzle opening.

The inlet 12A is defined in a central hub 29 of the part 14, from which hub radial webs 20 extend to a peripheral wall 21, on which the surface 30 is provided. These webs 20 buttress a flexible resilient upper web 22A of the part 14, on which upper web 22A said surface 17 is provided. A pair of gripping apertures 23 are provided in the web 22, and two of the ribs 20 are set down to provide spaces 25 so that posts 24 on the part 16 can be inserted into the body via the gripping apertures 23. The posts 24 preferably taper slightly so as to reach a minimum thickness adjacent to outer portions 17E of the surface 17 of the part 16 from which they depend, so that when they are gripped in the apertures 23 they are pulled downwards to urge the inclined sloping surfaces 17D and the formations 18A,B together.

The dependent flange means 31 comprises two part circular flanges 31A and B each of which runs peripherally of the web 22B from adjacent an end of the hinge 27 to adjacent the nozzle opening, and they are moulded so as to resiliently grip said peripheral surf ace 30 therebetween. Those portions 30A and B of the surface 30 gripped by these flanges 31A and B are preferably undercut to taper slightly so that the flanges 31A and B are a snap-fit on the part 16.

Figure 6:
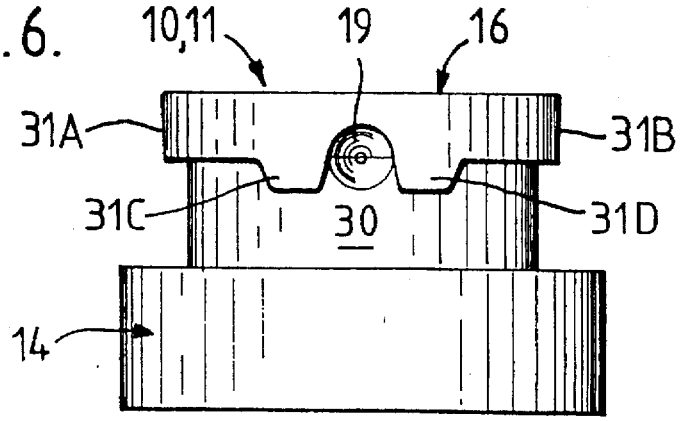
FIG. 6 shows the device in front elevation.

The flange means 31 together with posts 24 and gripping apertures all serve as parts of the retaining means to hold the part 16 down to serve as a snap fitting lid on the first part 14 which serves as a base, which retaining means provides a resilient bias urging the sealing means including the rib 41, recess 42, and sloping surfaces 17D as well as the abutment portions 17C into effective engagement. Further, during pivotal movement of the lid, as the lid approaches the upper end of the body, the posts 24, flange means 31, sloping surfaces 17 and rib 41 come to progressive engagement with the corresponding apertures, surfaces and formations on said upper end of the base 14 to serve as guide or interengagement means whereby to ensure that the lid finally snaps onto the body in the aforementioned correct relative position, and so that any fluid residue, e.g. cleaning fluid, is progressively squeezed out of the groove 42 to exit via its open ends 43, and is also squeezed progressively from between the formations 18A and B, as well as the surfaces 17D and the portions 17C. As the lid 16 snaps closed on the base 14, flange extensions 31C and D cover said ends 43 and the ends of the interface between the surfaces 17D and between the portions 17C as shown in FIG. 6.

Figure 1:
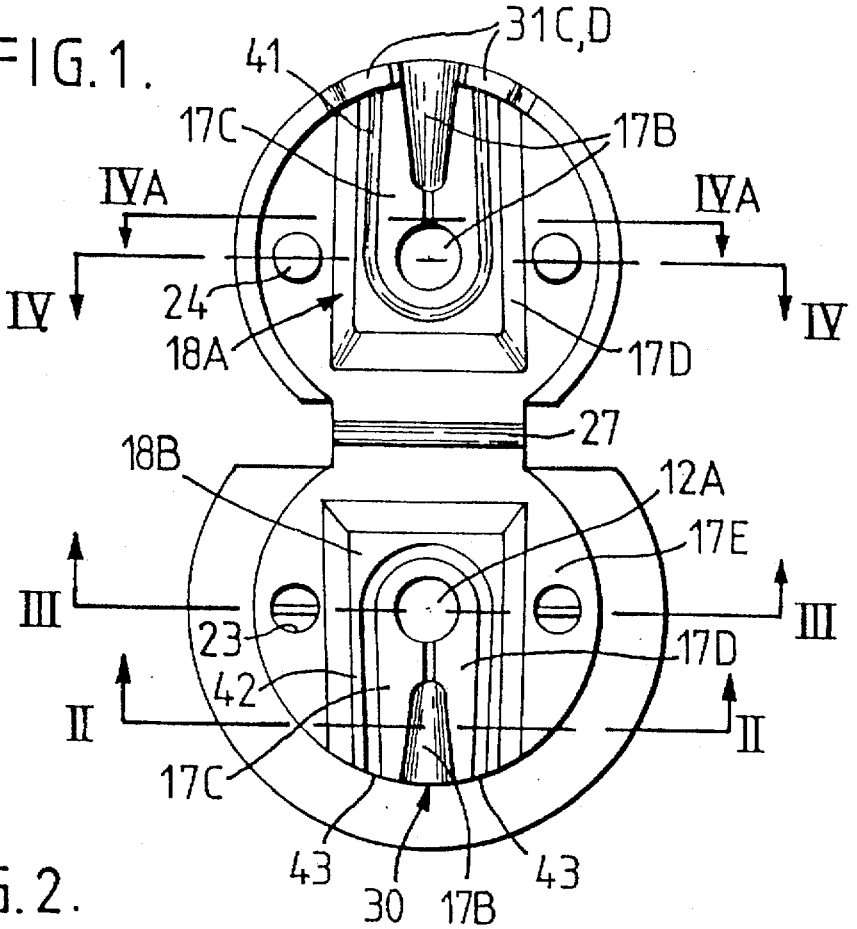
FIG. 1 shows a plan view of a first embodiment of a nozzle device of the invention with a lid in an open position.
Figure 2:
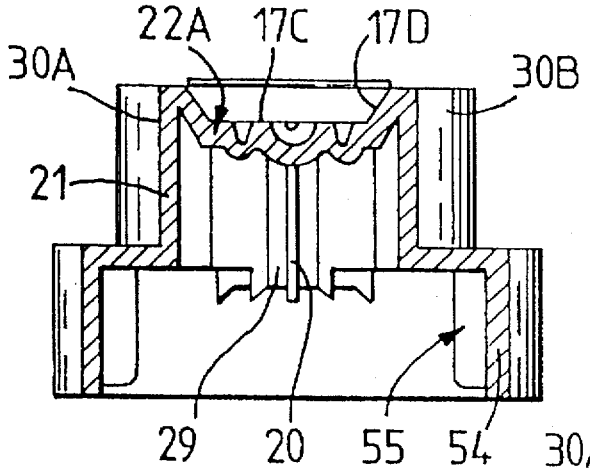
FIG. 2 shows a section of a base of the device on the lines II—II in FIG. 1.
Figure 3:
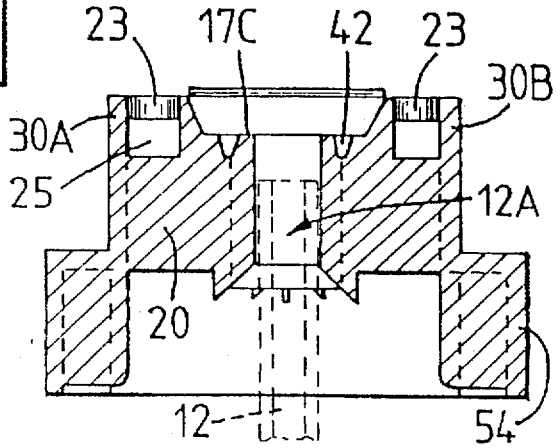
FIG. 3 shows a section of a base of the device on the lines III—III in FIG. 1.
Figure 5:
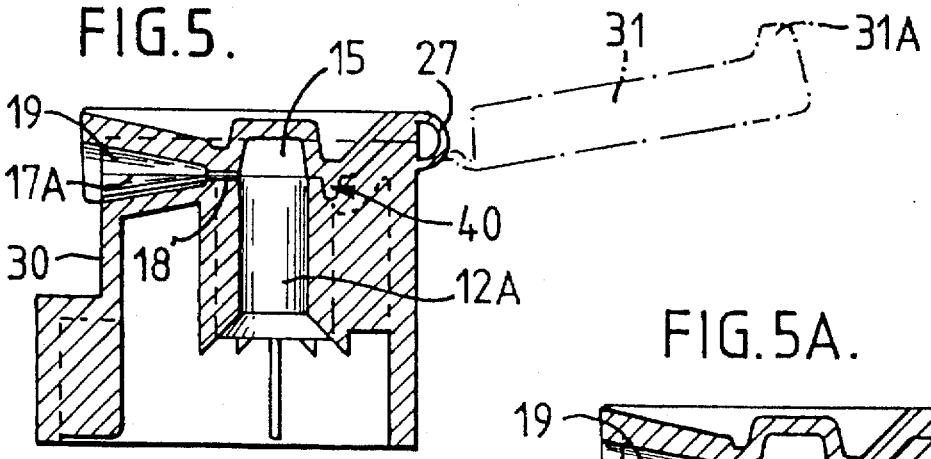
FIG. 5 shows a diametrical cross-section of the device with the lid closed.

When the lid is in an open position as shown in FIG. 1 and indicated in broken lines in FIG. 5, the surfaces 17 of the lid and of the base 14, including the groove 42, are easily cleaned by wiping, or by wiping with a suitable cleaning fluid, especially by wiping in a direction towards the nozzle opening 19 or, for outer parts of the now exposed surface 17 of the lid, towards the hinge 27, whereby to sweep or drag solid matter off these surfaces.

The flexibility of the plastics material further facilitates removal of hard dried matter adhering to said surfaces, by enabling the pliant lid and upper web 22 to be manipulated or flexibly distorted to reduce the adherence of solid matter thereto. The preferred plastics material is polypropylene, and the moulded body is preferably translucent. The hinge 27 is a short thin pliant web of said material, but the length of the hinge between said parts may be increased so that the lid is swingably tethered to the base, but is not confined to pivotal movement about a predetermined axis defined by the hinge.

The hinge reduces the risk of the lid or base being dropped and thereby reduces the risk of accidental damage thereto or loss thereof, and simplifies closure of the lid in correct alignment with the base.

Figure 7:
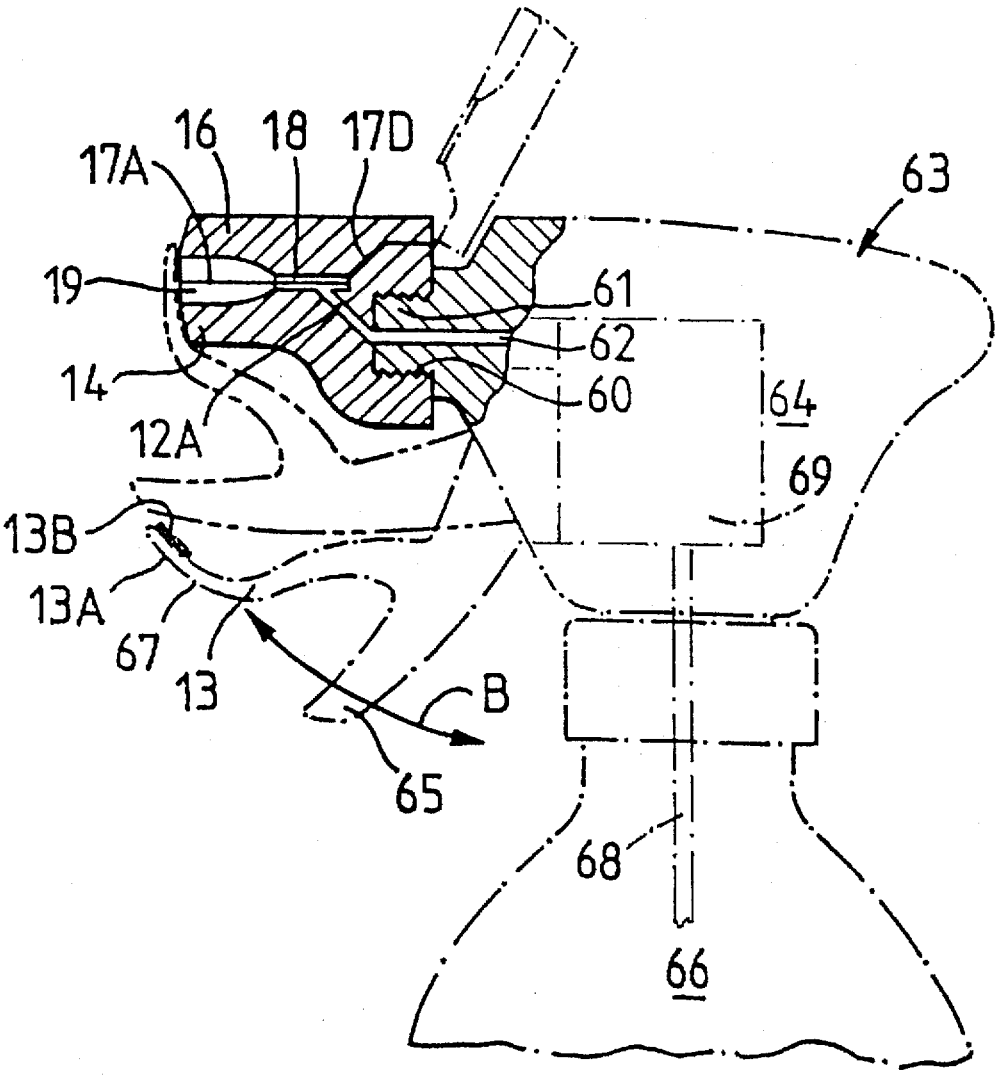
FIG. 7 is a part sectional view of a spraying apparatus incorporating the first embodiment of nozzle device.

FIG. 7 shows spraying apparatus comprising a hand held gun of known form fitted with a modified form of the first embodiment of the nozzle device. The first, base, part 14 of the device provides a threaded socket 60 which is screwed onto an outlet spigot 61 of the body 64 of the gun 63 of the spraying apparatus so that the inlet 12A, which is inclined in this embodiment, communicates with the pressurised fluid outlet duct 62 from a pump 69 of known form in the apparatus. The upper lid part 16 and lower base part 14 are otherwise internally constructed and hinged together as previously described, and are externally shaped to compliment the style of the apparatus 63.

If a cleaning member is required, an extension 67 can be provided on the trigger 65 and provided with a wiper 13B and a seal 13A so that it covers the front of the nozzle opening when the trigger is in a fully raised position as outlined in FIG. 7 and wipes the external surface around the nozzle opening 19 when the trigger is lowered to an in-use position (also outlined) for movement through a pumping arc indicated by arrow B to pump fluid from the reservoir 66 via a pipe 68 and the pump 69 to the duct 62.

Figure 8:
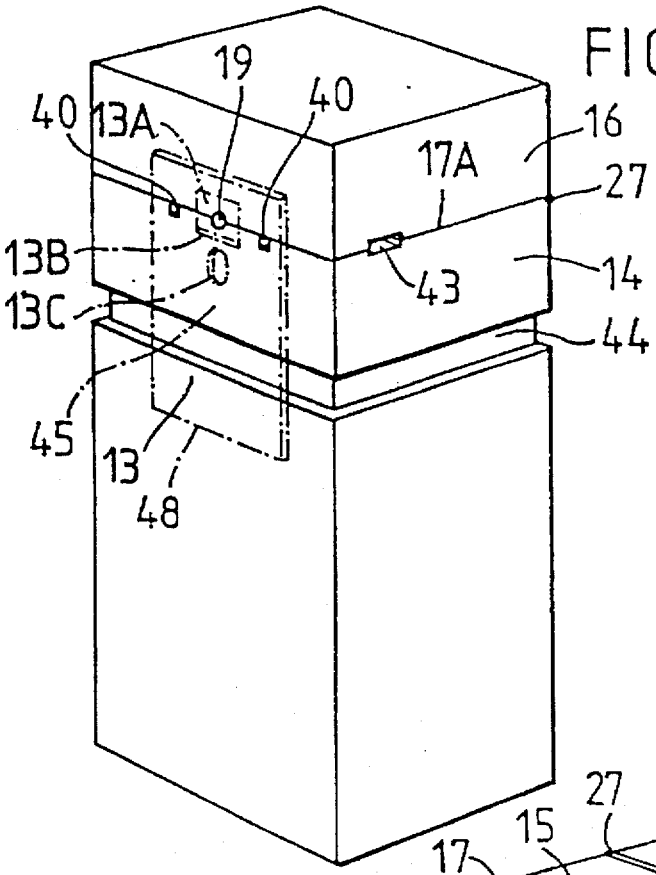
FIG. 8 shows a second embodiment in the operative condition.
Figure 9:
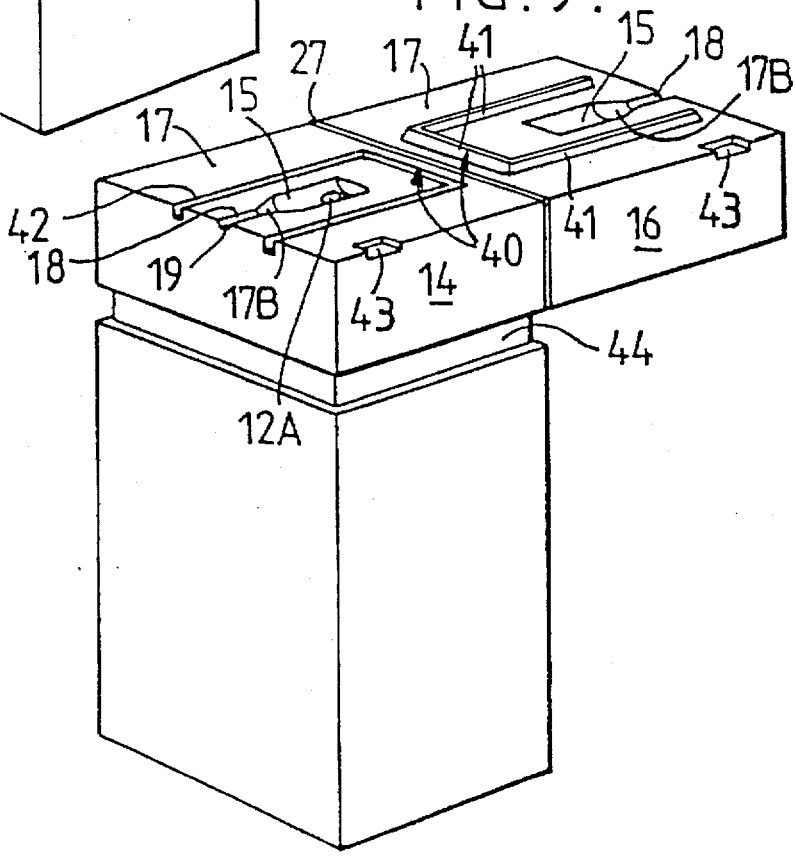
FIG. 9 shows the second embodiment in an inoperative condition, ready for cleaning.

In the second embodiment of the nozzle device for low pressure aerosol sprays, shown diagrammatically in FIGS. 8 and 9, with less elaborate sealing means and interengaging guide means. In this embodiment the part 14 of the body forms a base, and the part 16 of the body forms a lid pivotally attached to the base at the end remote from the nozzle 19 by a hinge 27, and the body is moulded from a less flexible material. The two parts each provide one surface 17, which surfaces are planar except for the parts 17B defining concavities and for the sealing means 40, as shown in FIG. 9. Alongside the cavities recesses 42 are formed in the base part 14 and sealing ribs 41 are formed on the upper lid part 16 to sealingly engage in the recesses, so as to serve as sealing means 40 bordering the nozzle orifice and passage to prevent egress of fluid across the interface 17A. In this embodiment the ribs are a snap-fit in the recesses so as to serve as retaining means for holding the two parts 14,16 together so that under normal conditions the junction or chamber 15, passage 18 and orifice 19 remain formed, i.e. the device normally assumes and maintains the operative condition. When cleaning is required the two parts 14 and 16 may be prised apart e.g. by insertion of a screwdriver blade in a pair of recesses 43 so that the upper part can be swung to the condition shown in FIG. 9 to expose said surfaces and concavities therein including the portions of the concavities defining the chamber 15. A feed pipe 12 connected to the inlet 12A is not shown as it is concealed by the part 14 and the upper end of a spray can 44 which end is recessed so that the part 14 can be depressed to actuate a normal valve (not shown) within the spray can 44 so that fluid can be supplied via the feed pipe 12 to the inlet 12A. In this embodiment, as shown in broken lines in FIG. 8 a cleaning member 13 is provided, and comprises a tongue 45 upstanding from the spray can 44, and provides a seal 13A, scraper 13B and aperture 13C. In a normal condition the nozzle orifice 19 is covered by the seal 13A until such time as the device is depressed against the pressure in the can so as to open the valve and bring the nozzle orifice 19 into alignment with the aperture 13A, and during that movement the nozzle orifice 19 will traverse the scraper or wiper 13B and be cleaned thereby.

Figure 4:
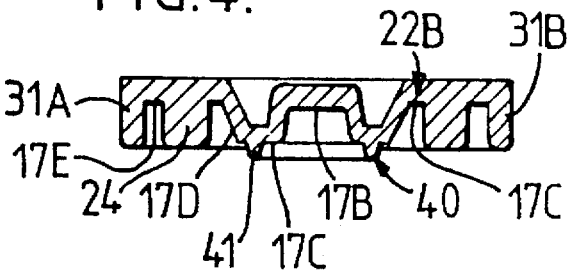
FIG. 4 shows a section of the lid of the device on the lines IV—IV in FIG. 1.
Figure 4A:
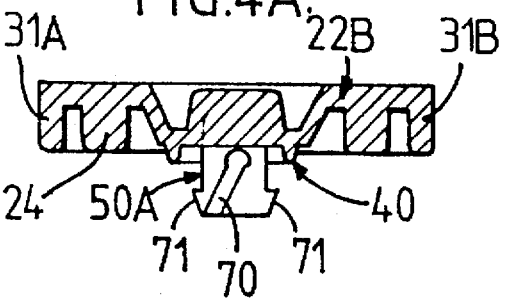
FIG. 4A shows a section of a modified form of the lid on the line IVA—IVA in FIG. 1.
Figure 5A:
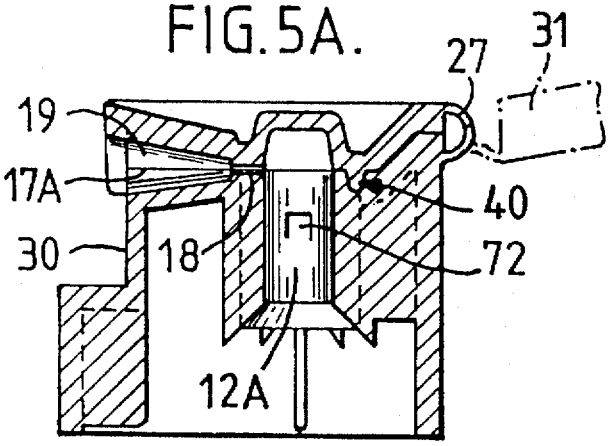
FIG. 5A is a view similar to FIG. 5 showing a modification thereof.
Figure 10B:
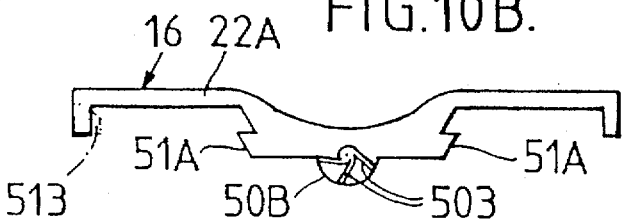

Modified forms of the first and second embodiment are shown in FIGS. 4A and 5A and in FIGS. 10A and 10B. These modified forms illustrate several modifications applicable all embodiments, namely:

1. That the nozzle opening 19, passage 18 and junction chamber 15 or at least the narrowest part thereof of minimum width can be provided by a concavity in one of said parts e.g. the bottom part 14, and that the corresponding defining portion 17B of the other part, e.g. the upper part 16, may be partially or substantially planar (FIG. 10). This is particularly useful where the minimum width of the feed passage or nozzle opening is less than 0.1 mm for very fine sprays.
2. That the abutment surfaces 17 may be stepped as is in the first embodiment to include sealing portions 17D which serve as sealing and guiding interengagement means bordering the portions 17B; and that the portions 17D may further include an elongate catch formation 51A on one thereof and a socket formation 52A on the other thereof to serve as the or further retaining means.
3. That the feed passage 12A (FIG. 10) may open eccentrically into the chamber or may have a vane 501 therein (FIG. 11) to cause the fluid to swirl in the chamber; or chamber 15 (FIGS. 10, 4A and 5A) or feed passage 18 (FIG. 4A) may include a swirl producing means 50, 50A, 50B which means may be a spiral flow guide 50 (FIG. 10) which may be free or attached to either of the parts 14,16, and is sufficiently resilient to stretch out as it is wiped. Alternatively, the swirl producing means may comprise a male member 50A (FIG. 4A) depending from the lid 16 into the inlet 12A which member has an inclined channel 70 therein to define with the inlet 12A a swirl producing duct in the junction leading to the passage 18. Or the means 50B may comprise a male formation 510 on the lid which formation substantially occupies the chamber 15 and has longitudinal grooves 502 therein forming passages for fluid to flow from the inlet 12A to inclined grooves 503 in the end face of the formation which provide swirl producing ducts to cause fluid to swirl as it enters the feed passage 18 (FIG. 10A).

In all forms the swirl producing means, or at least its flow guiding surfaces, is exposed for wiping when the lid is raised from the base.

4. That the releasable retaining means may include flexible resilient elongate forms 513 barbed catches 51 to engage in stepped open elongate sockets 53, to retain the two parts 14 and 16 with the surfaces 17 abutting, i.e. to retain said parts in the operative condition (FIG. 10A). The catches 51 may be sprung open by force or released manually to allow the second part to swing upwards about the hinge. The sockets and catches may be elongate and integrated as formations in the portions 17D e.g. 51A,B (FIG. 10) or may also be provided as radial formations 71,72 on the member 50 (FIGS. 4A and 5A).

That the feed passage 18 may be short and extend to a substantially two dimensional nozzle opening 19 at said surface 30 (FIG. 10A).

In both forms of the second embodiment, the nozzle device and/or spray can have been shown, diagrammatically, as being based on a rectangular shape whereas, in reality, the basic shape of the nozzle and the spray can will be generally circular in most instances, as exemplified in the first embodiment and in the third embodiment shown in FIGS. 11 to 14.

FIGS. 11 to 14 show a third embodiment of the nozzle device in a less diagrammatic form shaped, like the first embodiment to fit on a standard circular-section aerosol can 44 (partially indicated in FIG. 11). In this embodiment the lower part 14 has a skirt 54 around a socket 55 to receive the upper part of can 44 in known manner so that the feed pipe 12, which may be part of the valve device 53 of the can (FIG. 11) or part of the lower base part 14 (FIG. 12), opens into the inlet 12A. The inlet 12A opens directly into a chamberless junction 15 with the passage 18 which terminates at the nozzle opening 19 which is of outwardly divergent form. The surfaces 17 are stepped to provide the interengaging sealing means 17D. The hinge 27 is short, and as shown in FIG. 13, the parts 14 and 16 are provided with the releasable flexible retaining means 51,52.

In this embodiment, the optional cleaning means comprises the cleaning member 13 which passes through a slot 56 in the lower part 14, and has a base 57 which is urged into abutment with the can 44 by spring fingers 58 on the base, which fingers are compressed when the device is depressed (to open the valve) so that the opening 13C moves to register with the opening 19 as indicated in FIG. 12. A lug 59 prevents the member 13 falling back through the slot 56 when the device is removed from the can.

The invention is not confined to details of the foregoing examples and many variations are possible within the scope of the invention.

For example, the passage 18 may extend to the outer periphery surface 30 so that the nozzle opening 19 is substantially two-dimensional at said surface.

For example, any feature or form or function disclosed in any one embodiment may be employed or substituted in any other embodiment.

In all embodiments the webs 22A and B and the retaining means are preferably moulded so that the portions 17C come into abutment, as the lid is swung down onto the base, slightly before the retaining means comes into full retaining engagement so that the portions of the webs between the retaining means and said portions 17C are forced to flex resiliently and serve as springs applying forces urging the portions 17C and the adjacent sealing means into sealing engagement. Further, the retaining means is preferably shaped and sufficiently resilient to admit to being forced to yield resiliently to allow the lid to be swung open.

The invention further includes and provides a nozzle device or spraying apparatus incorporating any novel part or feature, or any combination of parts and features disclosed herein and/or in the accompanying drawings; and further includes mechanical and functional equivalents thereof. The terms used herein are by way of illustration and merely examples of terms which fall within generic terms and are to be understood as including synonyms and generic terms.

The nozzle opening or aperture 19 may, instead of being of circular cross-section, be of oval, ellipsoidal or elongate form, so that the fluid is discharged as a fan-shaped spray.

I claim:

1. A nozzle device (10) comprising a hollow unitary moulded plastic body (11) having a nozzle opening (19) to discharge fluid as a jet or spray; the body (11) comprising a first part (14) having an inlet (12A) to admit fluid under pressure into the first part, and a second part (16) movable relative to the first part; wherein the nozzle opening (19) and a feed passage (18) leading to the nozzle opening (19) meet at a junction and are defined between portions (17B) of abutment surfaces (17) of the first and second parts; and wherein the parts (14,16) are at least partially separable to expose the feed passage (18) and the nozzle opening (19) and the junction for wiping; and characterised in that the first part (14) is attached to the second part (16) to be swung away from the other (14) to separate and expose said surfaces (17) entirely whilst the parts (14,16) remain connected to the hinge, and in that said parts (14,16) have sealing means bordering said portions of said surfaces adjacent to said nozzle opening junction and feed passage; and in that said sealing means (17D:40,41) comprises a recessed formation (17D:41) which is disposed in one of said surfaces (17) and extends from the periphery 30 of said surface, and a projecting formation on the other surface which sealingly engages in a recessed formation (17D:40) when said parts (14,16) are swung to abut at an interface (17A) between said surfaces (17) and are held in abutment by resiliently releasable retaining means (40,41:51,52).

2. A nozzle device as claimed in claim 1 wherein the first part (14) is a base attachable to a fluid container vessel (43) having valve means openable by movement of the base to supply a fluid under pressure to the inlet (12A), and the second part is a lid (16) which can be swung into snap-fit engagement with the base.

3. A nozzle device as claimed in claim 2 wherein the retaining means (40,41:51,52) is of snap-fit form and can be forced to yield resiliently to allow the lid (16) to be pried open and wherein the parts come into abutment at said interface before the retaining means retainingly engages to hold said parts together.

4. A nozzle device as claimed in claim 1 wherein the surfaces (17) are stepped to provide inclined surface portions (17D) which serve as said sealing means and as interengaging guide means to bring said portions (17B) into alignment as the second part is swung to abut the second part whereby to ensure correct geometrical formation of the feed passage and nozzle opening.

5. A nozzle device as claimed in claim 1 wherein each of said surfaces (17) has a concavity (17B) therein which defines part of each of the nozzle opening (19), the feed passage (18) and the junction (15).

6. A nozzle device as claimed in claim 5 comprising swirl producing means to impart rotation to fluid flowing between said parts to the nozzle opening, which means is exposed for wiping when the parts are swung apart.

7. Spraying apparatus comprising a nozzle device as claimed in claim 2, a vessel (43) containing fluid under pressure, valve means actuable by depression of a pipe (12) in the valve means to release said fluid into said pipe, wherein the device (10) and pipe (12) are arranged so that manual application of pressure to a top surface of a flexible web of the lid is transmitted via the interface and said sealing means to the base to move the body towards said vessel for actuating said valve means.

8. Spraying apparatus comprising a nozzle device as claimed in claim 1 attached to an outlet (61,62) of a body (64) of the apparatus, a vessel (66) to contain fluid to be sprayed releasably attached to said body (64), and a trigger (65) actuable for pumping fluid from said vessel to said outlet (62).

9. Spraying apparatus as claimed in claim 8 wherein a cleaning member (21) is provided on the trigger to obscure and wipe said nozzle opening (19).

10. Apparatus as claimed in claim 7 wherein a cleaning member (13:45) is provided for the nozzle device (10) in order to obscure said nozzle opening (19) and to wipe said nozzle opening (19) when the body is depressed to open the valve means.

11. Spraying apparatus having a nozzle device (10) comprising a unitary-moulded plastic body comprising a lid and a base, each comprising a respective main web having an abutment surface to abut the abutment surface of the other main web and define therewith a nozzle opening open at the periphery of the body, a feed passage connecting said nozzle opening with a junction so that separation of said lid and base exposes said surfaces and the surface portions bounding said nozzle opening, feed passage and junction and a junction end of an inlet formed in the base, for wiping, wherein said surfaces and webs are shaped to provide sealing means and interengaging guide means both comprising complimentary shaped male and female formations which extend from said periphery to border said portions of said surfaces for determining the positions of said surface portions and effecting sealing around said surface portions, when the lid is held in abutment with the base by resilient retaining means.

12. Apparatus as claimed in claim 11 wherein the retaining means and interengaging guide means both comprise posts projecting from one of said parts through gripping apertures in the other of said parts.

13. Apparatus as claimed in claim 11 wherein the retaining means comprises flange means on one of said parts to embrace a peripheral surface of the other of said parts.

* * * * *